US005213475A

United States Patent [19]

Peterson et al.

[11] Patent Number: 5,213,475

[45] Date of Patent: May 25, 1993

[54] BURST RESISTANT ROTOR DISK ASSEMBLY

[75] Inventors: Stephen C. Peterson, West Chester; James C. Przytulski, Fairfield, both of Ohio

[73] Assignee: General Electric Company, Cincinnati, Ohio

[21] Appl. No.: 802,684

[22] Filed: Dec. 5, 1991

[51] Int. Cl.[5] ..... B63H 1/20

[52] U.S. Cl. ..... 416/219 R; 416/244 A

[58] Field of Search ..... 416/204 A, 212 A, 213, 416/214 A, 219 R, 219 A, 220, 198, 244 A, 244 R

[56] References Cited

U.S. PATENT DOCUMENTS

| | | | |
|---|---|---|---|
| 2,918,252 | 12/1959 | Haworth . | |
| 3,262,676 | 7/1966 | Huebner, Jr. et al. . | |
| 3,356,339 | 12/1967 | Thomas et al. . | |
| 4,062.638 | 12/1977 | Hall, Jr. | 416/244 A |
| 4,097,194 | 6/1978 | Barack et al. | 416/244 A |
| 4,102,603 | 7/1978 | Smith et al. | 416/244 A |
| 4,203,705 | 5/1980 | Wesbecher | 416/95 |
| 4,310,286 | 1/1982 | Peters et al. | 416/198 A |
| 4,521,160 | 6/1985 | Bouiller et al. | 416/218 |
| 4,536,932 | 8/1985 | Athey | 29/156.8 B |

FOREIGN PATENT DOCUMENTS

| | | | |
|---|---|---|---|
| 0109864 | 2/1944 | Sweden | 416/214 R |
| 0277780 | 1/1952 | Switzerland | 416/244 A |

OTHER PUBLICATIONS

D. J. Nicholas, "The Wide-Chord Fan Blade-A Rolls-Royce First", Paper presented 15-19 Jun. 1987 (NTIS Order No. N88-10789), Title sheet and page containing FIG. 9*b*.

*Interavia Aerospace Review*, "Civil Engine Wars," Feb. 1991, pp. 11 and 12.

*Flight International*, figure on p. 1473, 3 Dec. 1983.

*Primary Examiner*—Thomas E. Denion

*Attorney, Agent, or Firm*—Jerome C. Squillaro

[57] ABSTRACT

A rotor assembly for supporting rotor blades includes a plurality of axially adjoining discrete disks each having a rim. The rims include axial dovetail posts defining therebetween dovetail grooves for collectively supporting a respective blade dovetail therein. The disks are fixedly joined together by integral beams so that upon a crack failure of one of the disks, centrifugal load from the failed disk is transferred to an adjacent disk and crack propagation thereto is inhibited.

10 Claims, 5 Drawing Sheets

BURST RESISTANT ROTOR DISK ASSEMBLY

TECHNICAL FIELD

The present invention relates generally to aircraft gas turbine engines, and, more specifically, to a bladed-rotor assembly, such as a fan, subject to cracking failure.

BACKGROUND ART

A conventional craft gas turbine engine include a rotating fan having a plurality of circumferentially spaced fan blades removably mounted to a rotor. In one form, the rotor includes a disk having an outer rim and an inner hub with a radially extending web therebetween. The rim includes a plurality of circumferentially spaced, axially extending dovetail grooves for receiving axial dovetails of the fan blades for supporting the fan blades as they rotate with the disk.

A conventional rim has a width in the axial direction selected for ensuring acceptably low stress in the rim due to centrifugal loads imposed by the rotating blades on the rim. The width of the web is smaller than that of the rim for minimizing weight of the disk, and the width of the hub is larger than that of the web and may be up to about the width of the rim for providing suitable structural integrity of the entire disk.

Since the fan assembly has the largest outer diameter of the rotating blade rows of a conventional turbofan aircraft gas turbine engine, it typically has relatively high rotational energy due to centrifugal force or load generated thereby during operation. The larger the fan blades, the higher the potential centrifugal loads, and, therefore, the fans are typically run at relatively low rotational speeds to reduce the centrifugal loads so that stress generated thereby in the disk is below acceptable limits for obtaining a suitable useful life of the disk and avoiding catastrophic failure during operation.

Conventional rotor disks are known to fail due to propagating cracks under relatively high centrifugal loads. Cracks typically form at stress concentrations in the disk such as for example, undetected inclusions in the disk, or at stress risers such as holes in the disk. The cracks typically propagate in the radial direction through the hub, web, and rim thusly radially splitting the disk and resulting in failure.

Disks, therefore, are conventionally designed for obtaining limited stress therein due to centrifugal loads to reduce the likelihood of failure and for providing an acceptable service life. The disks may also be constructed in the form of a multi-disk assembly for spreading the centrifugal load between the respective disks so that failure of one disk does not result in failure of the entire multi-disk assembly.

In one exemplary turbofan engine, large fan blades are provided having a height of about 1 meter with the diameter of the fan assembly measured to the blade tips of about 3 meters. The fan rotates at about 2300 rpm, thusly resulting in substantial centrifugal loads imparted from the blades into the supporting rotor assembly. Accordingly, in order to prevent catastrophic failure of the rotor assembly due to centrifugal loads, an improved rotor assembly is desired which will prevent complete crack failure and provide an indication of the onset of such failure in order to effect appropriate remedial action. Furthermore, in view of the relatively large centrifugal loading in such a fan, a simpler more structurally efficient rotor assembly having reduced structural mass and reduced stress risers is desired.

OBJECTS OF THE INVENTION

Accordingly, one object of the present invention is to provide a new and improved rotor assembly for supporting rotor blades.

Another object of the present invention is to provide a rotor assembly for supporting large fan blades with improved structural efficiency.

Another object of the present invention is to provide a fan rotor assembly effective for inhibiting or arresting crack propagation for preventing complete rotor failure.

Another object of the present invention is to provide a fan rotor assembly having reduced stress risers therein.

DISCLOSURE OF THE INVENTION

A rotor assembly for supporting rotor blades includes a plurality of axially adjoining discrete disks each having a rim. The rims include axial dovetail posts defining therebetween dovetail grooves for collectively supporting a respective blade dovetail therein. The disks are fixedly joined together by integral beams so that upon a crack failure of one of the disks, centrifugal load from the failed disk is transferred to an adjacent disk and crack propagation thereto is inhibited.

BRIEF DESCRIPTION OF THE DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawings in which:

MODE(S) FOR CARRYING OUT THE INVENTION

Figure 1:
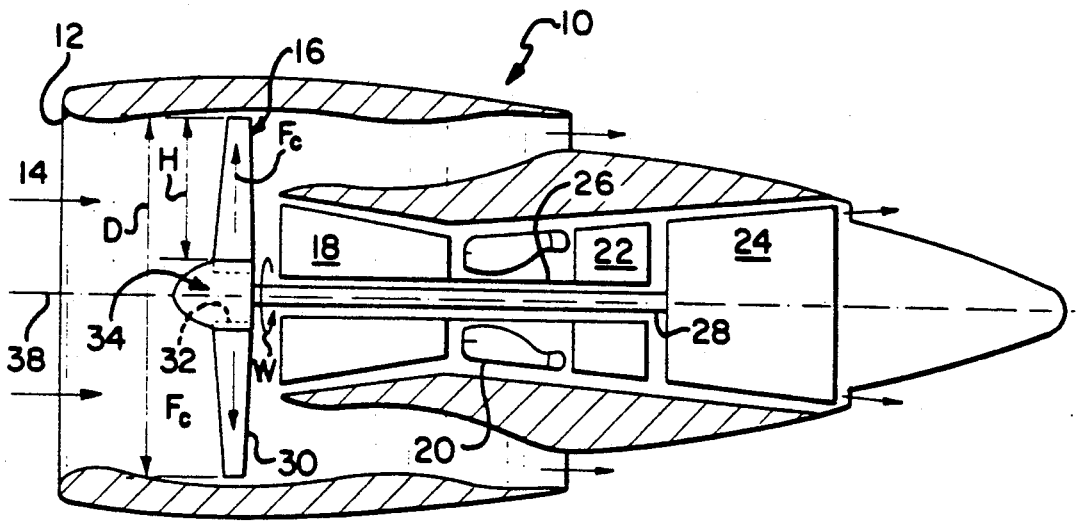
FIG. 1 is a schematic, longitudinal sectional view of an exemplary aircraft turbofan engine having a fan rotor assembly in accordance with one embodiment of the present invention.

Illustrated in FIG. 1 is an exemplary high bypass, turbofan gas turbine engine 10 having in serial flow communication an inlet 12 for receiving ambient air 14, a fan 16, a compressor 18, a combustor 20, a high pressure turbine 22, and a low pressure turbine 24. The high pressure turbine 22 is joined to the compressor 18 by a high pressure shaft 26, and the low pressure turbine 24 is connected to the fan 16 by a low pressure shaft, or drive shaft 28.

The fan 16 includes a plurality of circumferentially spaced apart rotor, or fan, blades 30 each having a conventional axial dovetail 32 supported to a rotor assembly 34 in accordance with one embodiment of the present invention. In a preferred and exemplary embodiment, each of the blades 30 has a height H of about 1 meter, and the fan 16 has an outer diameter D of about 3 meters measured between opposite blade tips. The low pressure turbine 24 is effective for rotating the rotor assembly 34 and the blades 16 at rotational speeds W of up to about 2300 rpm. The rotating blades 30 therefore generate considerable centrifugal loads or forces $F_c$ which must be accommodated by the rotor assembly 34.

In accordance with one object of the present invention, the rotor assembly 34 is constructed to arrest propagation of cracks therein prior to complete loss of structural integrity of the rotor assembly 34 supporting the blades 30. Crack propagation will occur to a point in which a notable unbalance or performance deterioration of the fan 16 will occur which may be conventionally detected so that appropriate remedial action such as shutting down the engine, for example, may be taken. The rotor assembly 34 will, however, continue to carry the centrifugal blade loading safely without complete destruction of the rotor assembly 34.

Figure 2:
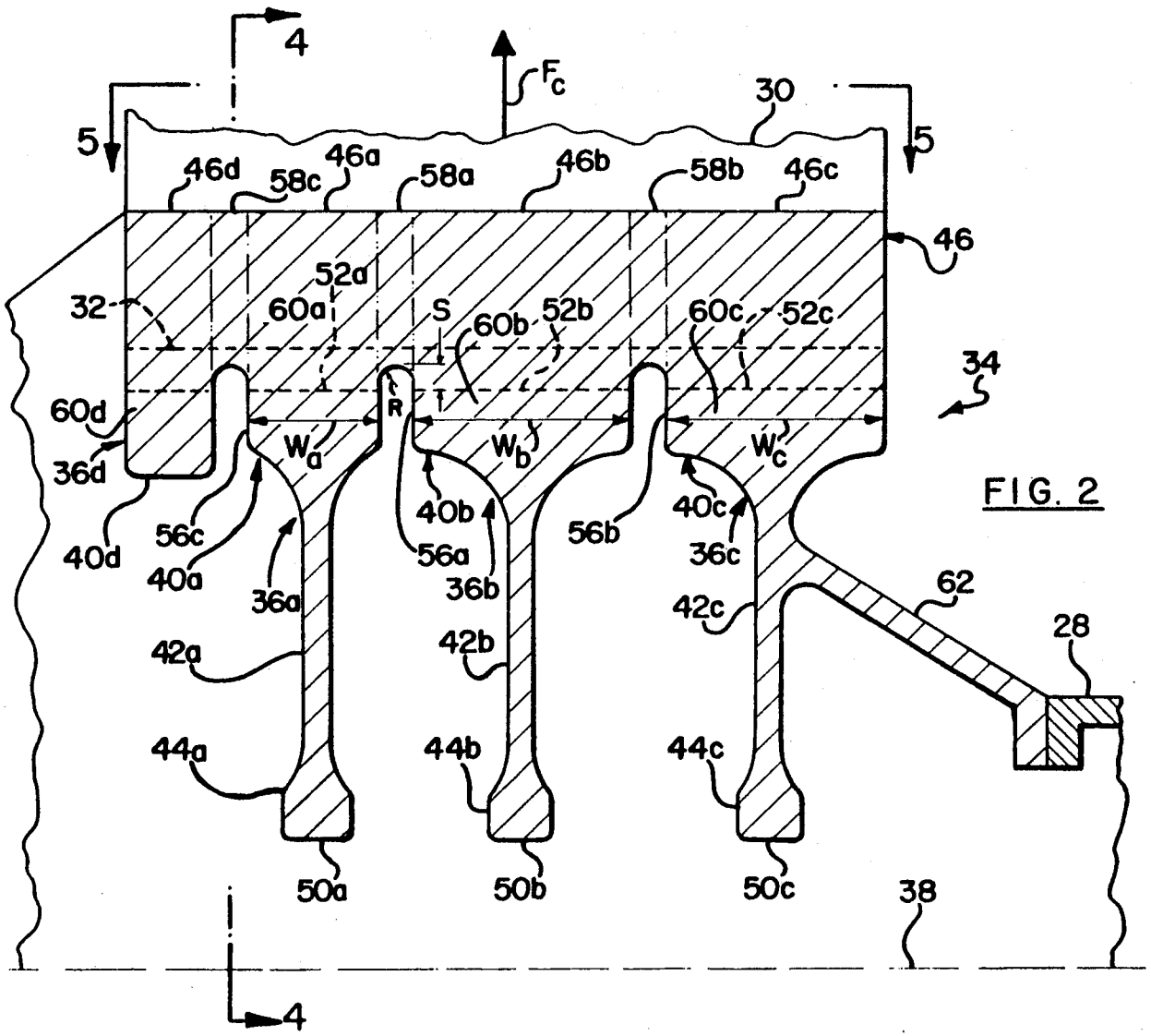
FIG. 2 is an enlarged longitudinal sectional view of a portion of the rotor assembly for the fan illustrated in FIG. 1
Figure 3:
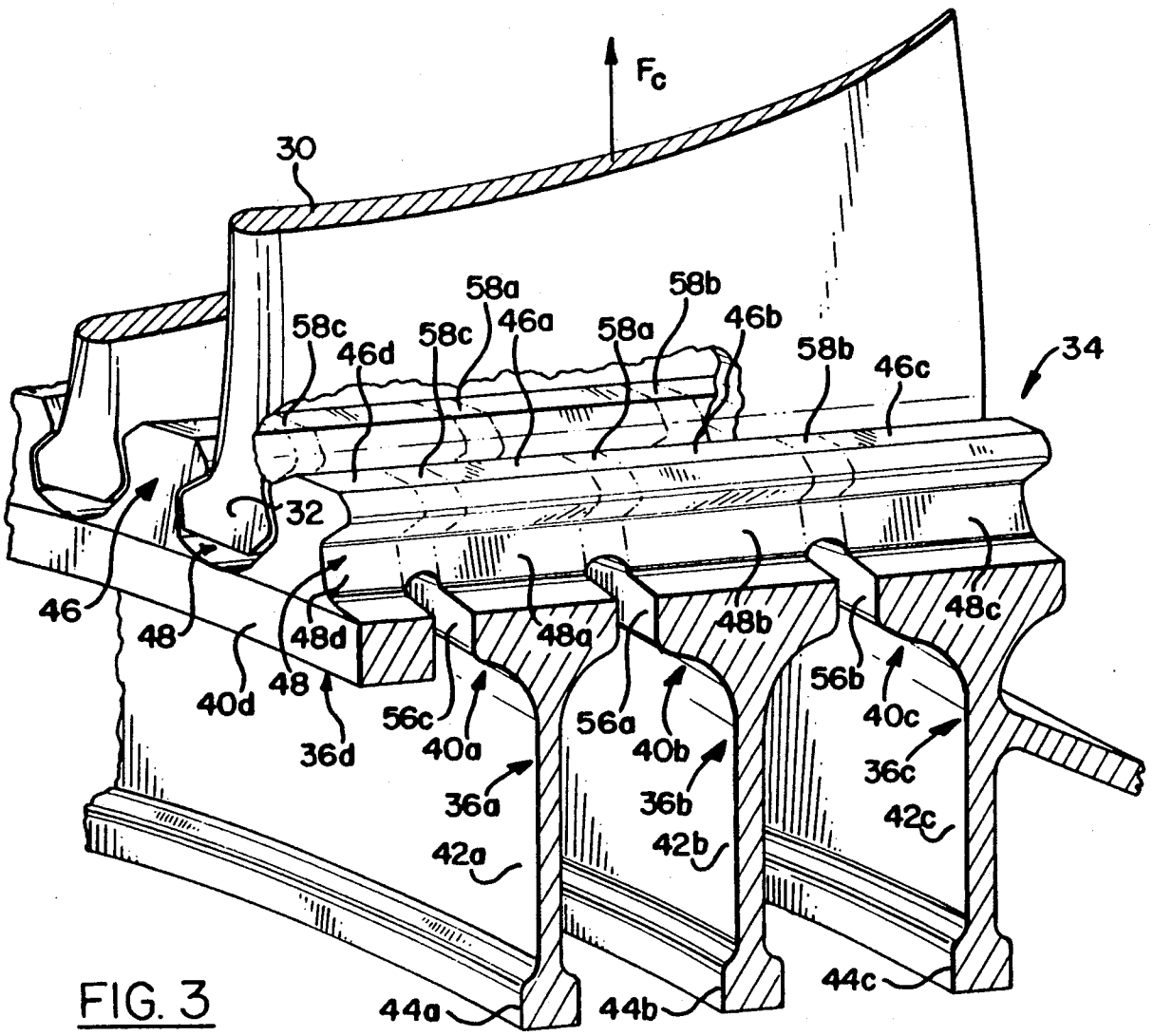
FIG. 3 is a perspective view of a portion of the rotor assembly illustrated in FIG. 1.

Illustrated in FIGS. 2 and 3 is an exemplary embodiment of the rotor assembly 34 having a plurality of annular, axially spaced apart, discrete rotor disks 36, for example first, second, and third disks 36*a*, 36*b*, and 36*c*. As used herein, multiply similar components will be identified with a lower case suffix following a common number designation, e.g. 36*a*, 36*b*, and 36*c*, and shown in the Figures. However, they will generally be reduced to in the multiple by using the number designation only to refer to all similar components.

Each of the disks 36 is disposed coaxially about a longitudinal axial centerline axis 38 of the disks and engine 10. Each of the disks 36 is conventionally configured and is generally symmetrical about a radial axis to have a respective radially outer rim 40*a*, 40*b*, 40*c*, a preferably imperforate web 42*a*, 42*b*, 42*c* extending radially inwardly from the respective rims 40, and an annular hub 44*a*, 44*b*, 44*c* extending radially inwardly from the respective webs 42.

Extending axially across the several disks 36 at the rims 40 thereof are a plurality of circumferentially spaced apart common axial dovetail posts 46 defining circumferentially therebetween a plurality of conventionally configured common axial dovetail grooves 48. More specifically, each rim 40*a*, 40*b*, 40*c* includes a respective plurality of circumferentially spaced apart individual axial dovetail posts 46*a*, 46*b*, 46*c* defining circumferentially therebetween respective pluralities of individual axial dovetail grooves 48*a*, 48*b*, 48*c*. Axially adjacent ones of the dovetail grooves 48 of adjacent ones of the disks 36 are axially aligned or collectively receiving and supporting a respective one of the complementary blade dovetails 32, with each disk 36 supporting a share of the centrifugal loads $F_c$ from the blades 30. Each of the blade rims 40 has a respective rim width $W_a$, $W_b$, $W_c$ selected for accommodating the centrifugal loads $F_c$ from the blades 30, with each of the rims 40 supporting a respective share of the total centrifugal loads $F_c$.

Adjacent ones of the webs 42 are preferably axially spaced apart which is due in part to the webs 42 having widths conventionally smaller than that of the respective rims widths. Each of the hubs 44 has a hub width which is conventionally larger than the respective web width and may be up to about the rim width. Each of the hubs 44 includes a conventional central bore 50*a*, 50*b*, 50*c*, and the hubs 44 are preferably imperforate from the bores 50 to the webs 42.

Figure 4:
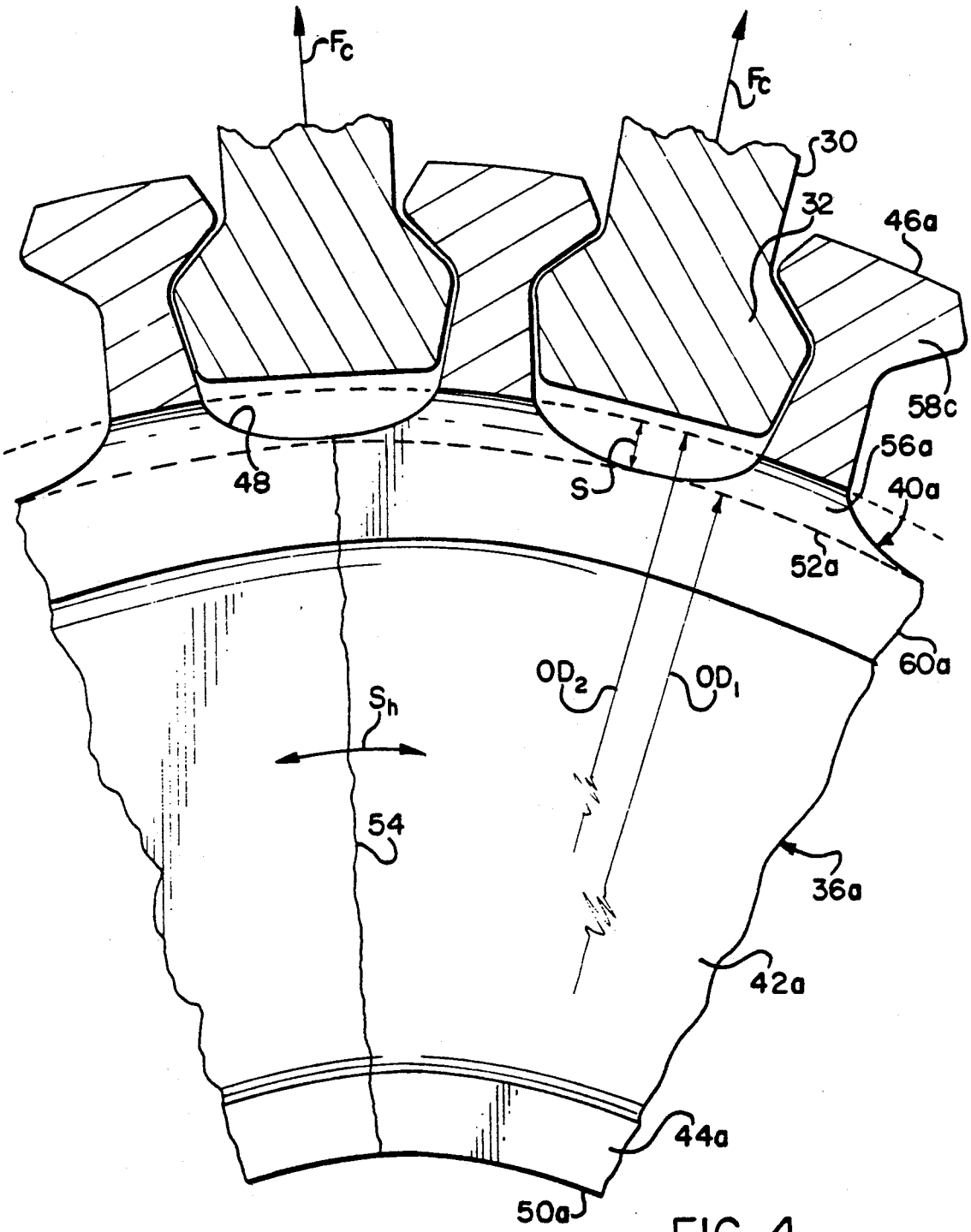
FIG. 4 is a radially extending, axial transverse view of the rotor assembly illustrated in FIG. 2 taken along line 4—4.

The centrifugal loads $F_c$ from the blades 30 are carried through the dovetails 32 and into the dovetail posts 46 joining the several disks 36. The centrifugal loads $F_c$ create conventionally known hoop stresses circumferentially around the disks 36 from the rims 40 to the hubs 44. As shown in FIG. 4, for example, the first disk 36*a* is completely annular from the first hub 44*a* through the first rim 40*a* in the radial direction and, therefore, accommodates the blade centrifugal loads $F_c$ by elastic expansion thereof with corresponding hoop stresses from the first bore 50*a* to an outer perimeter 52*a* thereof having a fist outer diameter $OD_1$. The first rim and hub 40*a* and 44*a* are wider than the first web 42*a* for accommodating the centrifugal loads $F_c$ with acceptable levels of the hoop stress therein. Nevertheless, the hoop stress typically has a maximum value in the first hub 44*a* at the first bore 50*a* which may lead to a crack initiation therein at a metalurgical inclusion for example.

An exemplary radial crack 54 is shown extending from the first bore 50*a* radially outwardly to the first outer perimeter 52*a* between circumferentially adjacent first dovetail posts 46*a*. The hoop stresses acting in the first disk 36*a* are schematically represented by the double arrow labeled $S_h$. The hoop stresses $S_h$ tend to propagate the radial crack 54 radially outwardly through the entire first disk 36*a*. The radial crack 54 reduces the ability of the first disk 36*a* to accommodate its share of the centrifugal forces $F_c$, which share must then be transferred through the dovetail 32 to the adjacent disks 36. Each of the disks 36 is preferably conventionally sized so that upon failure of any one of the disks 36, the remaining disks 36 can accommodate its share of the centrifugal load $F_c$ without complete failure of the entire rotor assembly 34. If the radial crack 54 were allowed to propagate from the first disk 36*a* into the second and third disks 36*b* and 36*c*, failure of the entire rotor assembly would result.

Accordingly, in order to reduce or prevent the likelihood of propagation of a crack, such as the radial crack 54, due to the hoop stress $S_h$, a continuous hoop path between adjacent ones of the disks 36 is broken in accordance with the present invention to isolate the hoop stress fields of the adjacent disks 36 from each other. In a preferred embodiment of the present invention as illustrated in FIGS. 2 and 3, axially opposing surfaces of the adjacent disk rims 40 are spaced apart to define circumferentially extending radial slots 56, e.g. a first slot 56*a* between the first and second disks 36*a* and 36*b*, and a second slot 56*b* between the second disk 36*b* and the third disk 36*c*. The radial slots 56 such as the first slot 56*a* illustrated in more particularity in FIG. 4 extend radially to a second outer diameter $OD_2$ radially outwardly from the respective outer perimeters 52 into the dovetail posts 46 to a distance S to circumferentially interrupt the continuous hoop path between adjacent disks 36 to reduce the likelihood of crack propagation therebetween.

As shown in more particularity in FIG. 3, a plurality of circumferentially spaced apart beams 58 extending axially between adjacent disks 36 and are preferably integrally fixedly joined to the adjacent disks 36 at the dovetail posts 46 thereof for providing a load sharing path between the adjacent disks 36 while at the same time interrupting the continuous hoop path therebetween to inhibit crack propagation therebetween. A first beam 58*a* is formed integrally between the first and second dovetail posts 46*a* and 46*b*, and a second beam 58*b* is formed integrally between the second and third dovetail posts 46*b* and 46*c* in the preferred embodiment. The dovetail posts 46 are preferably imperforate and with the beams 58 have substantially identical configurations to collectively define the common dovetail posts 46 extending axially across the several disks 36.

Figure 5:
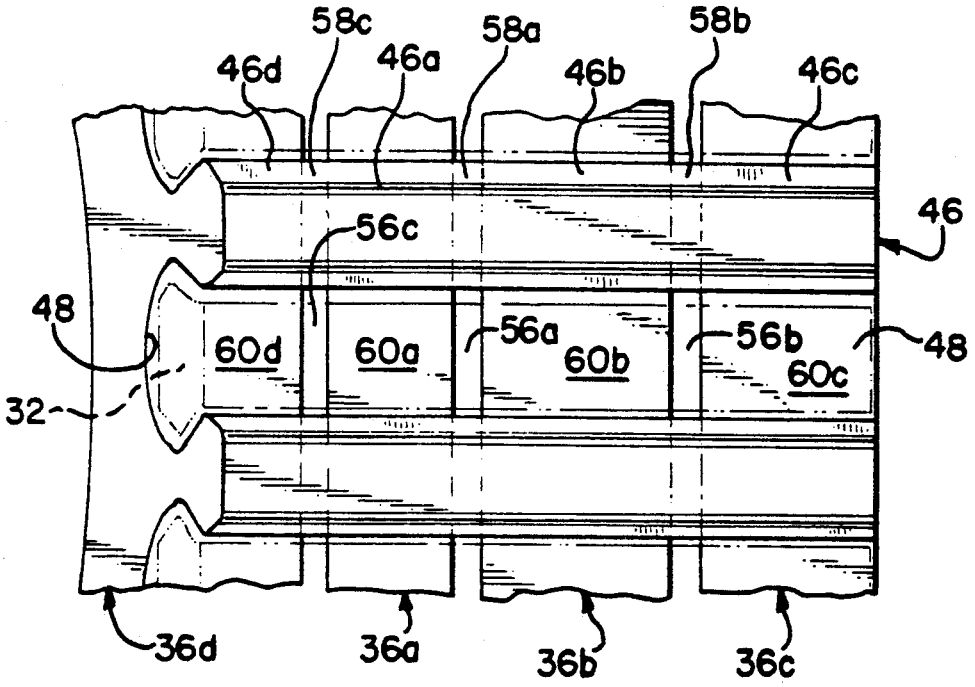
FIG. 5 is a top view of the rotor assembly illustrated in FIG. 3 taken along line 5—5.

As shown in FIG. 4, each of the disk rims 40 includes an annular ring or base 60 having the outer perimeter 52 which is the last radially outward continuous hoop path thereof. The dovetail posts 46 of each disk rim 40 extend radially outwardly from the respective bases 60, with the beams 58 being spaced radially outwardly above the bases 60 at the spacing S as shown in FIG. 4 for providing the radial slots 56 which axially interrupt the rim bases 60 as shown in FIG. 5 for breaking the continuous hoop path between the adjacent disks 36 to inhibit crack propagation therebetween. For example, upon failure of the first disk 36*a* by the radial crack 54, the share of centrifugal loads $F_c$ normally accommodated by the first disk 36*a* is transferred through the dovetails 32 to the remaining two disks 36*b* and 36*c*. And since the continuous hoop path between the first and second rim bases 60*a* and 60*b* as shown in FIG. 2 is interrupted by the first radial slot 56*a*, the likelihood of propagation of the crack 54 into the second disk 36*b* is substantially reduced.

Accordingly, the adjacent disks 36*b*, 36*c* help contain the failed disk 36*a*, and the crack propagation will be limited to the failed first disk 36*a*. Similarly, failure of either the second or third disks 36*b*, 36*c* will result in load transfer to the adjacent unfailed disks. And, the imbalance created by a failed disk can be conventionally detected so that remedial action, such as stopping the engine, may be effected.

Although the beams 58 as illustrated in FIG. 2 could be configured in alternate embodiments to extend between the adjacent disks at any suitable location from the hubs 44 to the rims 40, in the preferred embodiment of the present invention, the beams 58 extend axially solely between the respective dovetail posts 46 to most effectively inhibit crack propagation between the adjacent disks 36. More specifically, and referring to FIG. 4, a conventionally known stress concentration occurs at the bottom of the dovetail groove 48 and has a maximum value equidistantly between circumferentially adjacent dovetail posts 46 at the rim base outer perimeter, such as the first outer perimeter 52*a*. Accordingly, the radial crack 54, which may typically initiate in the disk web 42 or hub 44 will most likely propagate radially upwardly to that region of stress concentration between circumferentially adjacent dovetail posts 46 as illustrated in FIG. 4. By locating the beams 58 axially between axially adjacent dovetail posts 46 as illustrated in FIG. 2, the beams 58 are located generally circumferentially equidistantly between the stress concentrations of circumferentially adjacent dovetail grooves 48 which reduces the likelihood that the crack 54 will propagate through the beams 58 into the adjacent disk 36.

However, the radial slots 56 defined between the adjacent disk rims 40 themselves create local stress concentrations which are preferably spaced radially outwardly from the rim bases 60 as shown in FIGS. 2 and 4 to further reduce the likelihood of the crack 54 propagating toward such stress concentrations and through the beams 58 to the adjacent disk 36. As shown in FIG. 2, each of the beams 58 includes a radially inwardly facing lower surface which is preferably arcuate along the centerline axis 38 in the longitudinal plane illustrated which, along with the adjacent rim bases 60 define the respective radial slots 56. The beam lower surface is arcuate to reduce the conventionally known stress concentrations therefrom, and is spaced radially outwardly above the rim base 60 at the spacing S illustrated in FIGS. 2 and 4. The magnitude of the spacing S may be determined for each design application using conventional stress analysis for reducing or minimizing the collective stress concentrations due to the interaction of the slots 56 and the dovetail grooves 48 between the adjacent dovetail posts 46. In this way, the likelihood that the radial crack 54 would propagate through the dovetail posts 46 including the beams 58 is reduced.

In the exemplary embodiment of the invention illustrated in FIG. 2, three disks 36 are used to accommodate the centrifugal loads $F_c$ from the blades 30, although fewer or more disks 36 may be used in alternate embodiments. In this embodiment, the first disk 36*a* is a forward disk facing in an upstream direction which is supported solely on its aft side by the first beams 58*a* to the second or intermediate disk 36*b*. The second disk 36*b* is in turn supported on its aft side by the second beams 58*b* to the forward surface of the third disk 36*c*. The third disk 36*c* is the aftmost one of the disks 36 which includes an integral conical extension 62 which extends in an aft direction from the third web 42*c* which is conventionally fixedly joined to the drive shaft 28 for powering the fan 16 by the low pressure turbine 24. The second disk 36*b* is disposed between the first and third disks 36*a* and 36*c* in this embodiment and is fixedly joined to the drive shaft 28 by the third disk 36*c*. In an alternate embodiment, the second disk 36*b* could be directly fixedly joined to the drive shaft 28 in a two-disk assembly without the third disk 36*c*.

The relative sizes of the disks 36 may be selected for accommodating respective shares of the centrifugal loads $F_c$, and in the preferred embodiment illustrated in FIG. 2, the second and third rim widths $W_b$ and $W_c$ are substantially equal to each other and greater than the first width $W_a$ since they are more directly joined to the drive shaft 28.

Since the first or forward disk 36*a* is supported solely on its aft side to the second disk 36*b*, the failure thereof allows it share of the centrifugal loads $F_c$ to be transferred solely in an aft direction to the adjacent second disk 36*b*. For comparison purposes, failure of the second disk 36*b* will allow its load share to be transferred both forwardly to the first disk 36*a* and in the aft direction to the third disk 36*c*.

Accordingly, in order to improve the performance of the rotor assembly 34 in the event of failure of the first disk 36*a*, a stabilizing disk designated 36*d* is similarly joined to the first disk 36*a* on its forward surface. In the preferred embodiment, the stabilizing disk 36*d* includes solely another one of the rims 40, i.e. a fourth rim 40*d* and is characterized by the absence of both a web and hub extending radially inwardly therefrom for minimizing weight and reducing material volume subject to cracking. In all other respects, the stabilizing disk 36*d* is similar in structure and function to the other side disks 36*a*, 36*b*, and 36*c* including having integral third beams 58*c* axially joining fourth dovetail posts 46*d* thereof to the first dovetail posts 46*a*, with a corresponding third radial slot 55*c* extending radially upwardly between the fourth rim 40*d* of the stabilizing disk 36*d* and the first rim 40*a* of the first disk 36*a*.

The stabilizing disk 36*d* provides the fourth circumferentially continuous rim 40*d* for accommodating a portion of the centrifugal loads $F_c$ during normal operation with attendant hoop stresses generated therein, and, upon failure of the first disk 36*a*, its share of the centrifugal loads $F_c$ are transferred to both the second disk 36*b* as well as the stabilizing disk 36*d*. As shown in FIGS. 3–5, the first, second, third, and stabilizing rims 40*a*–40*d* are joined together in turn by the respective beams 58*a*–58*c* at all the dovetail posts 46 disposed circumferentially therearound. In alternate embodiments of the invention, the several disks 36 may be similarly joined together at fewer locations around the circumferences thereof.

In the preferred embodiment of the present invention as illustrated in FIG. 3 for example, the rotor assembly 34 may be readily conventionally manufactured using a common forging having the respective webs 36 and hubs 44 extending radially inwardly therein. The common dovetail posts 46 extending axially from the stabilizing disk 36*d* to the third disk 36*c* can be machined by conventionally removing material through the forgoing to form the dovetail grooves 48 with the common dovetail posts 46 remaining therebetween. The radial slots 56 may be conventionally formed by using a lathe to remove material from the forging between the disks 36 to define the several bases 60 of the rims 40. Alternatively, each of the disks 36 could be separately manufactured and conventionally welded together at the beams 58.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A rotor assembly for supporting a plurality of circumferentially spaced rotor blades extending radially outwardly from an axial centerline axis, each blade having an axial dovetail, comprising:

a plurality of axially spaced apart discrete disks, each disk having a radially outer rim including a plurality of circumferentially spaced apart axial dovetail posts defining therebetween a plurality of axial dovetail grooves, adjacent dovetail grooves of adjacent disks being axially aligned for collectively supporting a respective blade dovetail therein with each disk supporting a share of centrifugal load from said blade; and a plurality of circumferentially spaced apart beams extending axially between said adjacent disks and integrally joined to said adjacent disks at imperforate portions thereof.

2. A rotor assembly according to claim 1 wherein said beams extend between said disk rims.

3. A rotor assembly according to claim 2 wherein:

each of said disks rims includes an annular base, and said dovetail posts extend radially outwardly from said base; and said beams are spaced radially outwardly above said base and extend axially between said dovetail posts of said adjacent disks.

4. A rotor assembly according to claim 3 wherein adjacent ones of said dovetail posts of said adjacent disks and said beam therebetween have a substantially identical configuration to collectively define a common dovetail post extending axially across said plurality of disks.

5. A rotor assembly according to claim 4 wherein each of said beam includes a radially inwardly facing lower surface defining with axially opposing surfaces of said adjacent disk bases a circumferentially extending radial slot, said beam lower surface being arcuate along said centerline axis.

6. A rotor assembly according to claim 5 wherein said beam lower surfaces are spaced radially outwardly above said disk bases.

7. A rotor assembly according to claim 4 wherein said plurality of disks include a first disk having a first one of said rims and a first web extending radially inwardly from said first rim, and a first hub extending radially inwardly from said first web, said first hub having a central first bore.

8. A rotor assembly according to claim 7 further comprising a driveshaft; and said plurality of disks further include:

a second one of said disks having a second one of said rims and a second web extending radially inwardly from said second rim and a second hub extending radially inwardly from said second web, said second hub having a central second bore, and said second disk being fixedly joined to said driveshaft, and fixedly joined to said first disk by said beams; and another one of said disks configured as a stabilizing disk having solely another one of said rims, said stabilizing disk being fixedly joined to said first disk by said beams.

9. A rotor assembly according to claim 8 wherein said plurality of disks further include a third one of said disks having a third one of said rims and a third web extending radially inwardly from said third rim, and a third hub extending radially inwardly from said third web, said third hub having a central third bore, and said third disk being fixedly joined to said driveshaft, and fixedly joined to said second disk by said beams, said second disk being disposed between said first and third disks, and fixedly joined to said driveshaft by said third disk.

10. A rotor assembly according to claim 9 wherein said first, second, third, and stabilizing rims are joined together by said beams at all said dovetail posts disposed circumferentially therearound.

* * * * *